US006102693A

United States Patent [19]

Takahashi

[11] Patent Number: 6,102,693

[45] Date of Patent: Aug. 15, 2000

[54] PREHEATING METHOD IN A CONTINUOUS FURNACE

[75] Inventor: Susumu Takahashi, Yokohama, Japan

[73] Assignee: Kanto Yakin Kogyo K.K., Japan

[21] Appl. No.: 09/339,486

[22] Filed: Jun. 24, 1999

[30] Foreign Application Priority Data

Jul. 27, 1998 [JP] Japan ..... 10-244347

[51] Int. Cl.[7] ..... F27B 9/28

[52] U.S. Cl. ..... 432/8; 432/148; 432/149; 432/152; 432/72; 432/59

[58] Field of Search ..... 432/8, 58, 59, 432/72, 78, 145, 146, 147, 148, 149, 152

[56] References Cited

U.S. PATENT DOCUMENTS

| | | | |
|---|---|---|---|
| 3,923,449 | 12/1975 | Brock | 432/59 |
| 4,132,007 | 1/1979 | Voorheis | 432/8 |
| 4,133,636 | 1/1979 | Flynn | 432/72 |
| 4,290,749 | 9/1981 | de Muinck | 432/13 |
| 4,789,332 | 12/1988 | Ramsey et al. | 432/59 |
| 4,878,839 | 11/1989 | Wunning | 432/72 |
| 5,291,670 | 3/1994 | Surra et al. | 34/630 |
| 5,458,485 | 10/1995 | Righetti | 432/78 |

*Primary Examiner*—Denise L. Ferensic
*Assistant Examiner*—Jiping Lu
*Attorney, Agent, or Firm*—Shlesinger, Fitzsimmons & Shlesinger

[57] ABSTRACT

In order to prevent air pollution, gases evaporated from articles preheated in a preheating chamber of a continuous furnace are automatically and compulsorily sucked into a high-temperature chamber annexed to the preheating chamber by creating a negative pressure working in the high-temperature chamber. After the gases have been completely oxidized and decomposed in the high-temperature chamber at a high temperature and under an excess of oxygen, they are exhausted outside of the furnace via an exhaust-pipe extending through the preheating chamber, so that they join to heat the preheating chamber.

5 Claims, 2 Drawing Sheets

PREHEATING METHOD IN A CONTINUOUS FURNACE

BACKGROUND OF THE INVENTION

Before articles such as steel parts which are to be heat-treated for carbonizing, sintering, and so on, are heated in a heating chamber of a continuous furnace, they are commonly pre-heated in a preheating chamber preceding to the heating chamber.

This invention relate to a method for such preheating in a continuous furnace.

When steel articles and so on are heated in a preheating chamber of a continuous furnace to a range of temperature of about 100–700° C., organic substances such as oils and so on which are contained in or adhered to the articles, are evaporated, polymerized, or decomposed, whereby deadly poisonous gases are sometimes produced, and environments are most adversely polluted.

Dioxin is one of such deadly poisonous gases. In order to prevent the production of such gases, it is recommended by Japanese Welfare Ministry in a guideline for the prevention of generation of dioxin and so on to keep a temperature of combustion higher than 800° C., and to sustain a concentration of $O_2$ at an outlet of furnace higher than 6%.

It is, however, improper to make a heating temperature in a preheating chamber of continuous furnace higher than 800° C., in view of a primary object of preheating in the continuous furnace.

And moreover, it is disadvantageous to keep the preheating chamber under an excess of oxygen, because the articles preheated there would be readily oxidized.

SUMMARY OF THE INVENTION

In this invention, articles are heated, in a preheating chamber connected to a heating chamber, at a moderate temperature proper for preheating, and gases rising from the articles are automatically and compulsorily led into a high-temperature heat-treatment chamber which is annexed or branched to the preheating chamber and in which a negative pressure works. The gases are exhausted to the outside of a furnace, after they have been heated to a temperature higher than 800° C. and under an excess of oxygen.

THE DRAWINGS

FIG. 1 is an explanatory cross-section of a part of a continuous heating furnace, more particularly its preheating chamber annexed by a high-temperature heat-treatment chamber which can advantageously be employed for performing this invention method; and FIG. 2 is an explanatory perspective view of the furnace shown in FIG. 1.

DETAILED DESCRIPTION OF THE PREFERRED EMBODIMENTS

Figure 1:
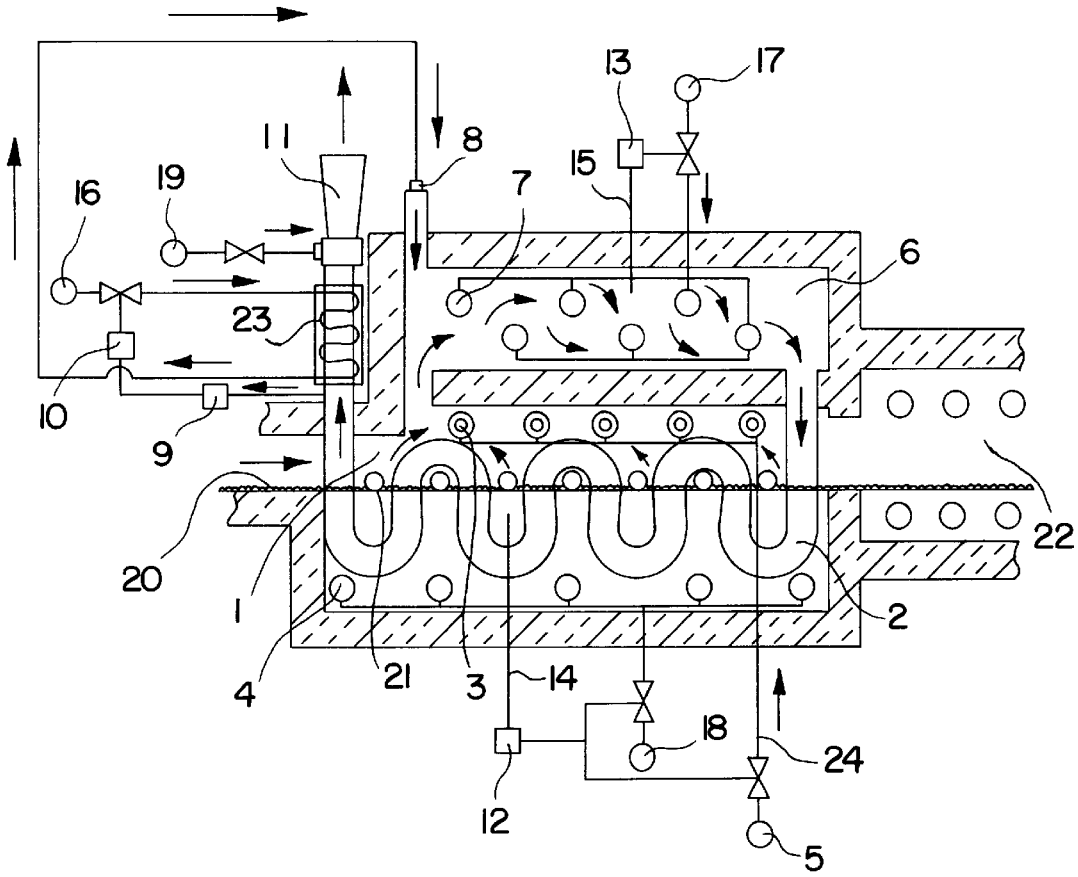
Figure 2:
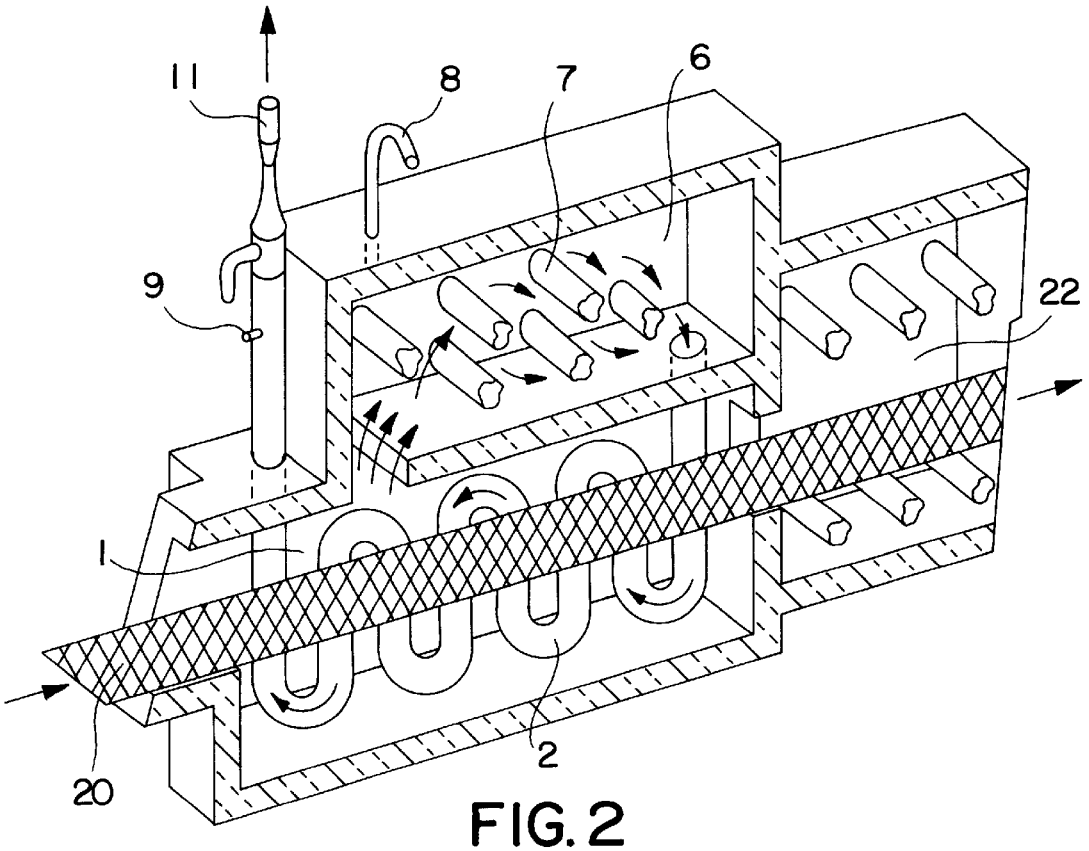

With reference to the drawings, a continuous heating furnace which can advantageously be employed for conducting this invention method, is explained below.

A preheating chamber 1 of the continuous heating furnace is connected at its longitudinal direction to a heating chamber 22, while the chamber 1 is at its upper direction annexed with a gaseous high-temperature heat-treatment chamber 6. A conveyor belt 20 circulates through the preheating chamber 1 and the heating chamber 22, so that articles 21 to be heated are transferred continuously through the furnace.

In the preheating chamber 1, the articles 21 are heated most commonly to such a predetermined temperature which is within a range of 100–700° C. and controlled by radiant heating tubes 4 and cooling tubes 3. To wit, the temperature within the preheating chamber 1 which has been detected by a thermocouple 14, is transmitted to a temperature control device 12. And, when the temperature thus detected is lower than the predetermined heating temperature, a fuel or electric power is supplied from a fuel or electric supply source 18 to the radiant heating tubes 4, whereby the preheating chamber is further heated. And, if the temperature of the preheating chamber 1 is higher than the predetermined heating temperature, air is supplied to the cooling tubes 3 from an air supply source 5 through a pipe 24, whereby the preheating chamber is cooled.

The above-mentioned gaseous high-temperature heat-treatment chamber 6 is connected to the preheating chamber adjacently to an entrance of the preheating chamber, while remotely to the entrance, it is connected to an end of an exhaust-pipe 2, which pipe extends through the preheating chamber and opens at it opposite end to the air by an ejector 11 fitted to its another end. This gaseous high-temperature heat-treatment chamber 6 is heated by radiant heating tubes 7 connected to a fuel or electric supply source 17 which is in turn controlled by a temperature control device 13 connected to a thermocouple 15.

To the end of the ejector 11 that is connected to the exhaust-pipe 2, there is connected an air supply source 19. The air supplied from this source 19 to the ejector 11, produces a negative pressure in the ejector. Since this negative pressure works also in the exhaust-pipe 2 and also in the gaseous high-temperature heat-treatment chamber 6, those organic gases such as oily substances and so on which have been evaporated from the articles 21 on the conveyor belt 20 and preheated in the preheating chamber 1, are sucked into the high-temperature gaseous heat-treatment chamber 6, and are exhausted to the outside of the furnace from the ejector 11 after they are subjected to a high temperature in the chamber 6 and pass through the exhaust-pipe 2.

When they pass through the exhaust-pipe 2, they contribute to heat the preheating chamber 1.

So that the organic gases such as oily substances which have been evaporated from the articles 21, can be treated in the heat-treatment chamber 6 at a high temperature and with an excess of oxygen, oxygen must be supplied excessively into the said chamber 6. For this end, a pipe 8 for supplying air with an excess of oxygen opens at the high-temperature heat-treatment chamber 6, and this pipe 8 is connected to an oxygen or air supplying source 16.

The supply of oxygen from the oxygen supplying source 16 to the high-temperature heat-treatment chamber 6 is controlled by a normal-pressure flow control device 10. To wit, by means of an excessive oxygen detector 9 which is connected to a part of the exhaust-pipe 2 locating outside of the furnace and which detects a concentration % of $O_2$ in an exhaust gas at said location, the control device 10 operates. For example, when the concentration % of $O_2$ is below than a predetermined amount, that is, for instance below 6%, the control device 10 operates to send oxygen or air into the high-temperature heat-treatment chamber 6 from the oxygen supplying source 16 through the pipe 8. Those portions of the oxygen or air supplying pipe represented by numeral 23, surround the exhaustion-pipe 2 helically, whereby oxygen or air is preheated at said portions before it enters into the chamber 6.

EXAMPLE 1

A continuous heating furnace having the aforementioned structures, especially the preheating chamber 1 and the high-temperature gaseous heat-treatment chamber 6 having the constructions and functions described above with reference to the drawings, was employed to practice the method of this invention, as follows.

A heat resisting steel conveyor belt 20 having a width of 800 mm was circulated through the preheating chamber 1 and the heating chamber 22 at a speed of 6 m/hr. Small-sized machine parts 21 of 180 Kg impregnated with a machine oil of 700 g were mounted on each longitudinal length of 1 m of the conveyor belt.

When the machine parts were passing through the preheating chamber 1 which was auxiliarily heated by the exhaustion-pipe 2 and kept at about 500° C. by the radiant heating tubes 4 and the cooling tubes 3, the machine oil was being evaporated from the machine parts thus heated. The evaporated machine oil was led into the high-temperature gaseous heat-treatment chamber 6 by means of the negative pressure working in said chamber 6, and in this chamber, they were heated to about 850° C. under an atmosphere of an excess of oxygen.

After they had been thus oxidized under a high temperature, they passed through the exhaust-pipe 2 while they acted as an auxiliary energy source for heating the preheating chamber 1, and finally they were exhausted from the ejector 11.

In them thus exhausted outside, methane, cyanogen, and ammonia were not detected, while free oxygen of about 6% was contained in them, showing that the machine oil evaporated from the machine parts had been completely oxidized and decomposed.

EXAMPLE 2

In this example, as the articles 21 to be preheated in accordance with this invention, a mixture of chips, waste paper, and rags which contained some aldehydo and paints, was employed. The mixture was preheated in the manners same to Example 1. All the substances evaporated in the preheating chamber from the mixture, were led into the high-temperature heat-treatment chamber, in which they were decomposed to water vapor and carbonic acid gas, and from which they were exhausted outside.

After the mixture had been thus heat-treated, it was carried out from the furnace as a carbonaceous mass containing some ashes.

As described above in detail, the articles 21 are gradually heated, as they enter into the preheating chamber 1 from its entrance, temperature around which is about a room temperature, and as they pass through the preheating chamber towards the heating chamber 22. When their temperature reaches a range of about 100–700° C. at a preheating stage and prior to a succeeding real heating stage, organic pollutive substances such as oil, fat, and so on contained in them are subjected to reactions including evaporation, polymerization, and decomposition, resulting in converting into deadly poisonous organic gases, dusts, or particulates.

In the method in accordance with this invention, such deadly poisonous gases and so on are exhausted outside only after they have been completely oxidized and decomposed. Before they are released into the air, they are compulsorily led into the chamber 6, which is kept at a temperature higher than 800° C., and in which air with a excess of oxygen prevails. In said chamber, they are completely oxidized and decomposed, and then, they are released outside of the furnace.

What is claimed is:

1. A preheating method in a continuous furnace which comprises preheating articles in a preheating chamber connected adjacent one end thereof to a high-temperature chamber and adjacent its opposite end to a heating chamber, and which is characterized by causing gases coming out from the articles in the preheating chamber to be led to the high-temperature chamber annexed to the preheating chamber by creating a negative pressure working in the high-temperature chamber, causing the gases to be oxidized in the high-temperature chamber at a high temperature and under an excess of oxygen, and causing the gases to be exhausted outside of the furnace via an exhaustion-pipe, one end of which opens at the high-temperature chamber, the other end of which opens outside of the furnace, and which pipe extends intermediate its ends through the preheating chamber, whereby the gases are utilized to heat the preheating chamber.

2. The preheating method as claimed in claim 1 including producing the negative pressure working in the high-temperature chamber, by maintaining said other end of the exhaustion-pipe under suction.

3. The preheating method as claimed in claim 1, including maintaining the high-temperature chamber under an excess of oxygen, by measuring free oxygen contained in the gases exhausted from the furnace, and in accordance with results of measurement, supplying oxygen into the high-temperature chamber when needed.

4. The preheating method as claimed in claim 3, including maintaining the supply of oxygen into the high-temperature chamber so that free oxygen contained in the gases exhausted from the furnace can be more than 6%.

5. The preheating method as claimed in claim 1, including maintaining the high-temperature chamber at a temperature higher than 800° C.

* * * * *